US005209087A

United States Patent [19]

Cox

[11] Patent Number: 5,209,087

[45] Date of Patent: May 11, 1993

[54] HIGH SECURITY REMOVABLE CORE CYLINDER LOCK

[76] Inventor: Terry L. Cox, 9510 Westpark, Houston, Tex. 77063

[21] Appl. No.: 945,686

[22] Filed: Sep. 16, 1992

[51] Int. Cl.[5] ..... E05B 27/04

[52] U.S. Cl. ..... 70/369; 70/495

[58] Field of Search ..... 70/367-369, 70/371, 421, 493-496

[56] References Cited

U.S. PATENT DOCUMENTS

| | | | |
|---|---|---|---|
| Re. 30,198 | 1/1980 | Oliver et al. | 70/364 A |
| Re. 31,910 | 6/1985 | Oliver | 70/369 |
| 3,722,240 | 3/1973 | Spain et al. | 70/364 A |
| 3,990,282 | 11/1976 | Sorum | 70/495 |
| 4,412,437 | 11/1983 | Smith | 70/383 |
| 4,440,009 | 4/1984 | Smith | 70/383 |
| 4,741,188 | 5/1988 | Smith | 70/383 |
| 4,809,525 | 3/1989 | Cox | 70/100 |
| 4,866,964 | 9/1989 | Hall | 70/369 |

*Primary Examiner*—Lloyd A. Gall

*Attorney, Agent, or Firm*—Daniel N. Lundeen; Andrew S. Pryzant

[57] ABSTRACT

A removable core cylinder lock having separate key-operated tumbler controlled fences is disclosed. The separately keyed fences permit differentiation between a locking/unlocking operational mode and a core insertion/removal mode to enhance security and applicability of the lock. The lock comprises a core received by a housing. The core has a longitudinal fence retractable by alignment of one group of tumblers and a transverse retainer retractable by alignment of a second group of tumblers wherein both fence and retainer engage the housing to lock the core therein. Insertion of a proper unlocking key permits retraction of the fence without retraction of the retainer so that the core can be rotated in the housing but not removed therefrom. Insertion of a proper removal key permits retraction of the fence and retainer for removal of the core from the housing. In such manner, one core can be rapidly substituted for another to change the keying for the unlocking mode.

15 Claims, 5 Drawing Sheets

HIGH SECURITY REMOVABLE CORE CYLINDER LOCK

FIELD OF THE INVENTION

The present invention relates to a "locked core" removable core cylinder lock suitable for use in high security applications. More particularly, the present invention relates to a removable core lock using a separate tumbler operated fence mechanism to lock the core and prevent the removal thereof without a suitable core removal key.

BACKGROUND OF THE INVENTION

Rotatably housed cam or cylinder locks are well known in the art. Such locks are made up of a self-contained core comprising locking pins and a fence operated by the pins. Insertion of an unlocking key aligns the pins and permits retraction of the fence thus allowing the core to be rotated and a locking cam, for example, to be disengaged. An exemplary version of the cylinder lock is made by Medeco Security Locks Inc. of Virginia and described in U.S. Pat. No. 3,722,240 to Spain et al. hereby incorporated herein by reference.

It is typically desirable to restrict access to the lock core yet permit general entry to the lock. Thus, the locking/unlocking operation and the core removing operation of the lock can be separated so that two different keys are required—a general access key to disengage the lock and a master key capable of removing the core.

In U.S. Pat. No. 4,866,964 to Hall, a removable core lock is provided with a core retaining spring clip which fits in a groove in the core and extends through a slot in a shell. When a core removal key, which is longer than a lock operating key, is inserted into the lock, the lock upon rotation lifts the spring clip to allow core removal.

On closer analysis, it can be seen that the core removal prevention mechanism described above. has a relatively low security rating because a holder of an operating key can potentially defeat the mechanism and remove the core, e.g. by lengthening the operating key. This, however, is generally not a problem in applications where access to the lock operating key is restricted to a small number of people, such as, for example, in a showcase, lock box or safe. In applications where access to an operating key is relatively widespread such as in doors of apartment, hotel or office buildings and a single master key is used for replacing the core (i.e. for changing the keying of the lock), a higher security means for preventing core removal is preferred, since anyone with an operating key can, by simple modification of the key, remove the core and determine the master key combination, and thereby obtain unauthorized access to all locks keyed to the master.

It is, therefore, desirable that both the locking/unlocking and core insertion/removal operations of the locking mechanism would be tumbler controlled utilizing different tumbler combinations. Thus, two distinct keys (operation and master) having a differing overall combination of tumbler actuating grooves could be employed and unauthorized removal of the core could be greatly inhibited.

SUMMARY OF THE INVENTION

The present removable core lock comprises separate fences controlled by different tumbler combinations to bifurcate an ordinary locking/unlocking mode from a core insertion/removal mode. Thus, separate keys having a different bitting can be used to operate the different fences. In such manner, the security of the core removal mode can be greatly enhanced even when widespread access to locking/unlocking keys is prevalent. Furthermore, a single master key incorporating the core insertion/removal grooves operating the core removal/insertion fence can be made so that one core can be rapidly substituted for another to change the keying of the lock for ordinary operation. Such dual fence removable core locks can be advantageously employed as door locks in hotel, apartment, office, and other buildings where high security and central control over all the building locks are important.

In one embodiment, the present invention provides a removable core cylinder lock having separate tumbler-controlled key-operated fences. The lock includes a lock core having a keyway, a plurality of pin tumbler bores aligned with the keyway and a fence recess adjacent the bores. The core is slideably received in a lock housing having a longitudinal cavity, a locking recess formed in a wall of the cavity, and a transverse retaining surface. A tumbler pin is disposed in each of the bores and is biased toward the keyway. A transverse opening is formed in each tumbler pin and is adapted to be aligned with the fence recess when properly positioned by a key inserted in the keyway. An outwardly biased fence having an outer locking surface engageable in the locking recess and at least one inward projection receivable in a tumbler opening is disposed in the fence recess. A normally outwardly biased retainer having an outer member engageable with the retaining surface and at least one inward projection receivable in a tumbler opening is also disposed in the fence recess. The lock also includes means for inwardly biasing the retainer for retraction thereof in the core removal mode. The core is in a locked position with respect to the housing by interengagement between the fence and the locking recess. The core is operable in an unlocked, unremovable mode by insertion of a proper operating key in the keyway to selectively position the pin tumblers for aligning each inward projection of the fence with a respective pin tumbler opening without alignment of each inward projection of the retainer with a respective pin tumbler opening, so that the fence is inwardly slideable for disengagement of the locking surface from the locking recess upon rotation of the core with respect to the housing and the outer member of the retainer is maintained in slideable engagement with the retaining surface to keep the core in the housing. The core is operable in a removal mode by insertion of a proper removal key to position the pin tumblers for aligning each inward projection of the fence and of the retainer with a respective pin tumbler opening so that the fence and retainer are inwardly slideable upon rotation of the core with respect to the housing for disengaging the locking surface from the locking recess and the retainer from the retaining surface to allow removal of the core from the cavity.

In a preferred embodiment, the retainer includes an inner arm carrying the inward projection or projections, an outer arm supported outwardly on the fence, and a member rigidly connecting the inner and outer arms, and wherein the retainer is biased inwardly by a spring disposed between the fence and the inner arm. The fence recess on the core has a longitudinal segment and a transverse segment, with the fence disposed in the longitudinal segment and the retainer disposed in the transverse segment. The transverse retaining surface comprises a sidewall of a radial segment formed in the locking recess or an endwall of the housing. The outer arm outward support is a narrow finger formed in the fence and received in a central channel in the retainer adjacent the outer arm.

As an alternate embodiment, the retainer can include two or more inward projections receivable in separate tumbler openings. A second retainer similarly disposed to the first can be used to specify the direction of core rotation in the unlocking mode.

As another embodiment the present invention provides a lock combination comprising the removable core lock described above, an unlocking key and a core removal key.

As a further embodiment, the present invention provides a method of disengaging a removable core cylinder lock, comprising the steps of selectively positioning pin tumblers by insertion of a proper operating key in the keyway of the removable core cylinder lock described above, wherein each inward projection of the fence is aligned with a respective pin tumbler opening without aligning each inward projection of the retainer with a respective pin tumbler opening; and inwardly sliding each inward projection of the fence into a respective pin tumbler opening for inward disengagement of the locking surface of the fence from the locking recess by rotation of the core with respect to the housing, wherein the outer member of the retainer is maintained in slideable engagement with the retaining surface to keep the core in the housing. To remove the core, the method further includes the steps of selectively positioning a pin tumbler or tumblers to align each inward projection of the retainer with a respective pin tumbler opening, inwardly sliding each inward projection of the retainer into a respective pin tumbler opening for inward disengagement of the retainer outer member from the retaining surface, and removing the core from the housing.

DETAILED DESCRIPTION OF THE INVENTION

Figures 1, 1A, 1B, 4A:
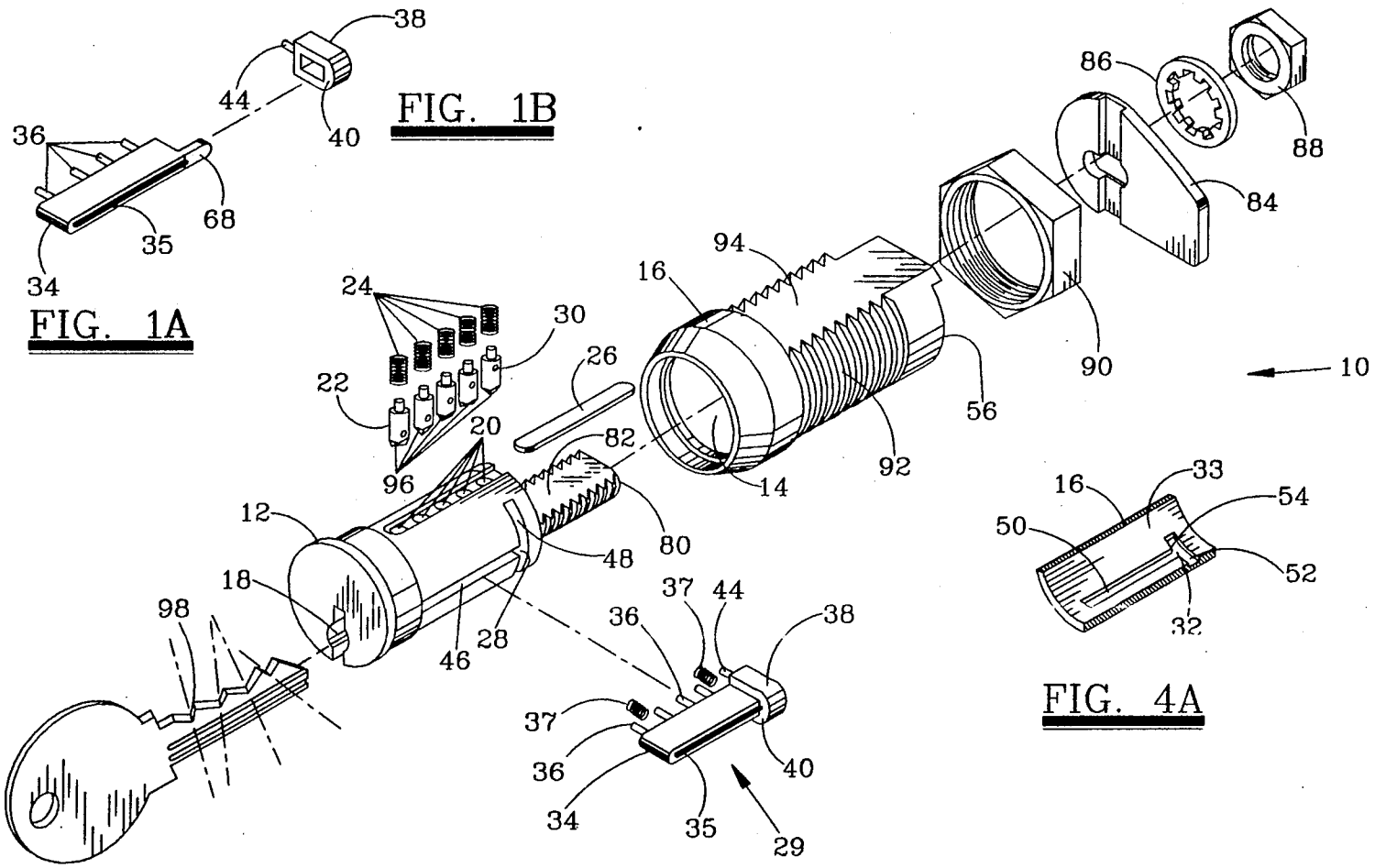
FIG. 1 is an exploded view of an embodiment of the removable core cylinder cam lock of the present invention showing in particular a preferred dual fence assembly.
FIG. 1A is a perspective view of a locking/unlocking fence portion of the dual fence assembly in FIG. 1.
FIG. 1B is a perspective view of a core insertion/-removal fence portion of the dual fence assembly in FIG. 1.
FIG. 4A is a cut away partial perspective view of a lock housing illustrating the locking recess in the inside wall of the housing cavity having a radial segment for a core locking retainer.
Figure 2:
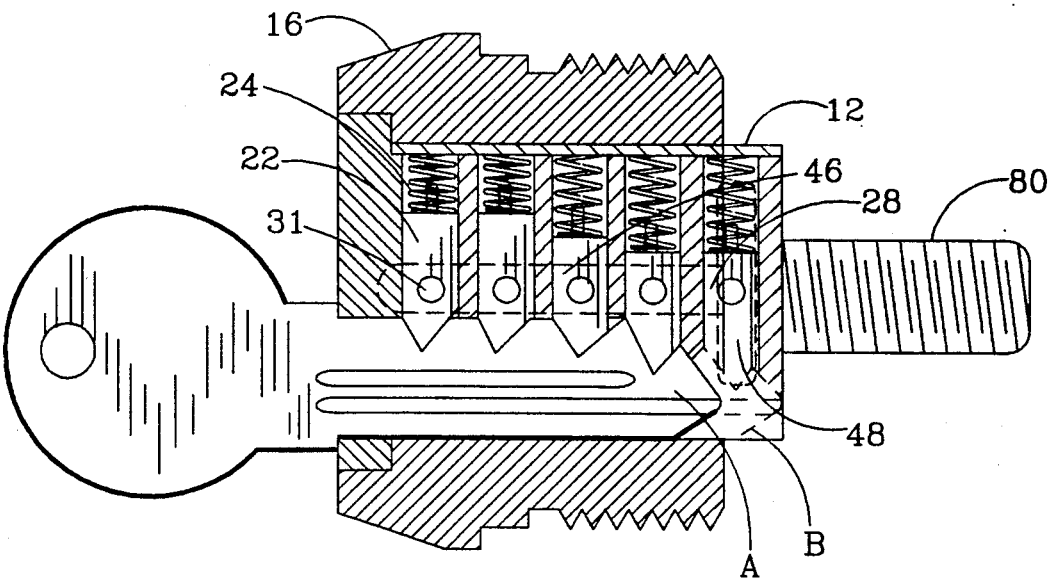
FIG. 2 is a side schematic view partially cut away, partially in cross-section of an embodiment of the present removable core cylinder lock showing an interaction of the locking tumblers and two operating keys, wherein a core removal key B having an additional groove to engage an additional tumbler which is adjacent an insertion/removal fence recess segment of the dual fence recess formed in the cylinder core is compared to an unlocking key A inoperable for core removal.

An auxiliary, tumbler-controlled fence is used to secure a lock core of a removable core cylinder lock in a lock housing and define two distinct modes of operation—(1) unlocking; and (2) core removal. Because retraction of the fence and the auxiliary are specified by differing tumbler combinations, each locking mode can be disengaged by a separate key. In such manner, the security of lock networks employing a single master key can be greatly enhanced even though operating keys for individual locks in the system are widely prevalent. In such instances the master key is also a core removal key for rapid replacement of the core to change the keying of the unlocking mode of the lock.

Referring to FIGS. 1–4A, a removable core lock 10 has a removable lock core 12 slideably received in a longitudinal cavity 14 of a housing 16. As is well known, the removable Core 12 has a keyway 18 and a plurality of bores 20 receiving pin tumblers 22 aligned with the keyway 18 The tumblers 22 are inwardly biased in the tumbler bores 20 by tumbler springs 24 which in turn are secured in the bores 20 by a Cover 26 which is conveniently pressed-fit into place. The core 12 also has a fence recess 28 adjacent the tumbler bores 20 receiving a fence assembly 29. A transverse opening 30 formed in the tumbler pins 22 is adapted to be aligned with a similar opening 31 at the bottom of the fence recess 28 when properly positioned by a key inserted in the keyway 18. The tumbler pins 22 Can have an alternate set of transverse openings (not shown) adjacent the openings 30 for use with a master key as is known in the art.

The fence assembly 29 received in the fence recess 28 cooperates with an opposing locking recess 32 formed in an interior wall 33 of the cavity 14 in the housing 16. The fence assembly 29 is made up of an outwardly biased fence 34 having an outer locking surface 35 engageable in the locking recess 32 and at least one inward projection 36 receivable in a tumbler opening 30. The fence 34 is typically biased outward by one or more springs 37 received in a spring recess 39 as is known in the art.

The fence assembly 29 includes a normally outwardly biased auxiliary fence or retainer 38 also disposed in the fence recess 28. The retainer 38 has an outer surface 40 engageable with a transverse retaining surface formed in the housing 16 and at least one inward projection 44 receivable in a tumbler opening 30. The transverse retaining surface forms a stop for the retainer 38.

In a preferred embodiment, the fence 34 is longitudinally disposed in a longitudinal segment 46 of the fence recess 28 and the retainer 38 is transversely disposed in a transverse segment 48 of the fence recess 28. The locking recess 32 (FIG. 4A) also includes a longitudinal segment 50 and a radial segment 52 opposite respective longitudinal and transverse segments 46, 48 of the fence recess 28. The retaining surface comprises a sidewall 54 of the radial segment 52 of the locking recess 32. Alternatively, the retaining surface can be an endwall 56 of an appropriately dimensioned housing 16 as in FIG. 3.

As seen in FIGS. 1, 3, 5, and 6–7, the fence 34 and retainer 38 cooperate to provide means for selectively biasing the retainer 38 outwardly in a locked condition or inwardly to simultaneously retract both the fence 34 and the retainer 38 in the core removal mode. The retainer 38 is preferably made up of an inner arm 58 carrying the inward projection or projections 44, an outer arm 60 supported outwardly on the fence 34 and a member 62 rigidly connecting the inner and outer arms 58, 60. A spring 64 received in a central channel 66 between the fence 34 and the inner arm 58 serves to inwardly bias the retainer 38 when compressed by inward sliding of the fence 34 in the fence recess 28. The fence 34 preferably has a narrowed finger 68 (or neck area) generally outwardly supporting (biasing) the outer arm 60 but suitable for traveling inward in the channel 66 and transmitting inward sliding of the fence 34 to the retainer 38.

It can be seen that the retainer 38 can be mounted at any position along the length of the fence 34 including in the middle (not shown) or at an end as shown in FIGS. 1–6. At an end position, the retainer 38 is mounted to the finger 68 formed in the fence as mentioned above. For positioning in the middle, a neck (not shown) can be made in the fence 34.

Figure 8:
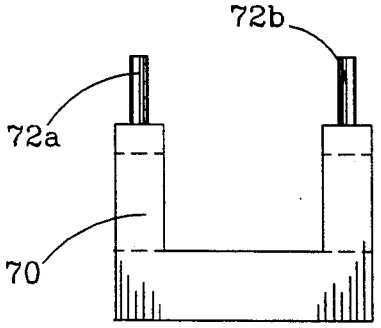
FIG. 8 is a longitudinal side schematic view of an alternate embodiment of the retainer fence showing dual tumbler projections.

While the retainer 38 is illustrated having a single inward projection 44 receivable in a single transverse tumbler opening 30, a compound retainer 70 having two or more inward projections 72*a*, 72*b* as shown in FIG. 8 can be used in a conventional manner to enhance the security of a core removal key.

In an alternate embodiment illustrated in FIGS. 11–14, a plurality of unlocking modes can be defined (in addition to the core removal mode) by employing two or more similar individual retainers in concert with the fence, wherein each unlocking mode disengages the fence and a different retainer or combination of retainers. As an example, a two retainer removable core lock of the present invention, can define two unlocking modes and a core removal mode. In addition, a locking recess can be employed so that the direction and/or arc length of core rotation in each unlocking mode is specified.

In the example shown in FIGS. 11–14, a fence assembly 100 comprises a fence 102 having dual finger members 104 and dual retainers 134 mounted thereon. The fence assembly 100 is received in an appropriately defined fence recess 108 made in a core 110. A suitable locking recess 112 is formed on the inside cavity wall of a housing 114 for cooperation with the fence recess 108. The locking recess 112 includes dual radial segments 116, 118 having a transverse retaining sidewall 120, 122 engaging the retainers 134 as a longitudinal direction stop. The radial segments 116, 118 also form radial direction stops 124, 126 to limit the direction and arc length through which the core 110 can be rotated in a given unlocking mode. Where the segments 116, 118 are radially offset by 90° from the axis, one unlocking key will rotate the cylinder 90° counterclockwise and the other unlocking key will rotate the cylinder 90° clockwise. The core removal key will concurrently retract the fence and both retainers 134. It is understood that the cooperation of the various elements in the two-or-more-retainers embodiment is similar to that of the single-retainer embodiment described previously and that the number of tumblers and tumblers per fence or retainer (in excess of the one minimum) is a matter of practitioner preference.

The present removable core cylinder lock can be used in conjunction with any suitable locking member such as a cam, bolt, plunger, electronic contact, and the like wherein rotation of the core disengages the lock by retracting the cam, bolt, etc. In FIG. 1 a typical cam type lock is shown. A threaded member 80 having a flat surface 82 is affixed to an end of the core 12 and receives a cam-shaped bolt 84 held in place by a lock type washer 86 and a nut 88. The lock housing 16 is conventionally installed in a door, for example by a nut 90 engaging threads 92. The housing has at least one flat surface 94 to prevent rotation of the housing in the door.

For ease of core replacement in applications such as in a cam lock, the threaded member so can be formed on an endpiece (not shown) which is separable from the core body when it is desired to remove the core to rekey the lock. An exemplary core body/endpiece core lock combination is illustrated in Hall which is hereby incorporated herein by reference.

The present removable core cylinder lock lo can be made from a conventional cylinder lock such as, for example, a cam lock commercially available under the tradename BIAXIAL from Medeco Security Locks, Inc. of Virginia modified to incorporate the retainer(s). This particular type of lock has a relatively high security rating because tumbler key surfaces 96 which engage a key bitting 98 are offset from the axis. This permits a greater number of permutations of the key bitting per tumbler and enhances difficulty at counterfeiting the key.

Figure 3:
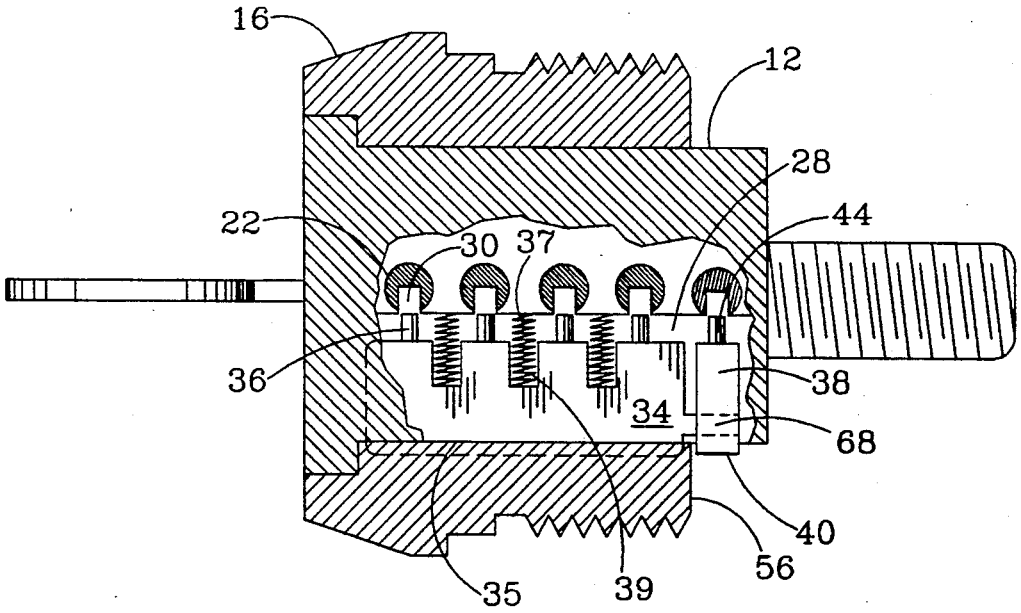
FIG. 3 is a side schematic view partially cut away, partially in cross-section of the removable core cylinder lock of FIG. 2 rotated counterclockwise by 90° showing an interaction of the fence assembly with the tumbler pins aligned for inward movement of the fences for unlocking and/or core removal by rotation of the key.
Figure 4:
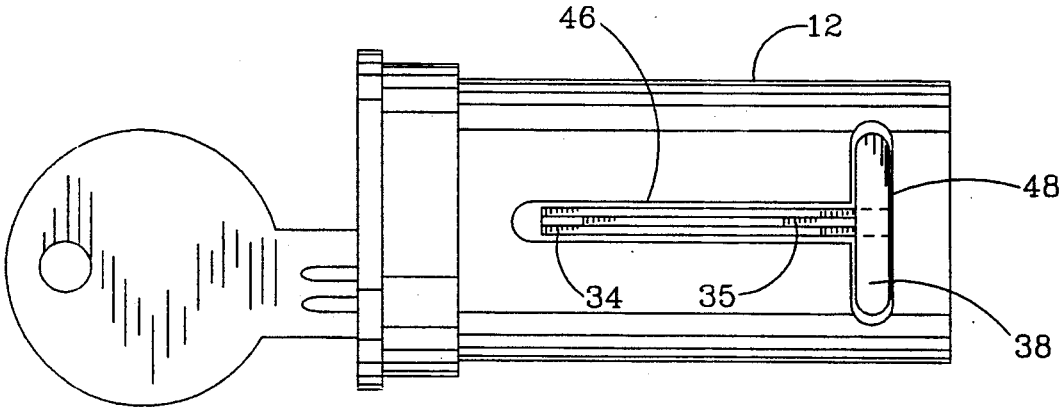
FIG. 4 is a side schematic view of the core of the present removable core lock showing a fence assembly in a fence recess.
Figure 5:
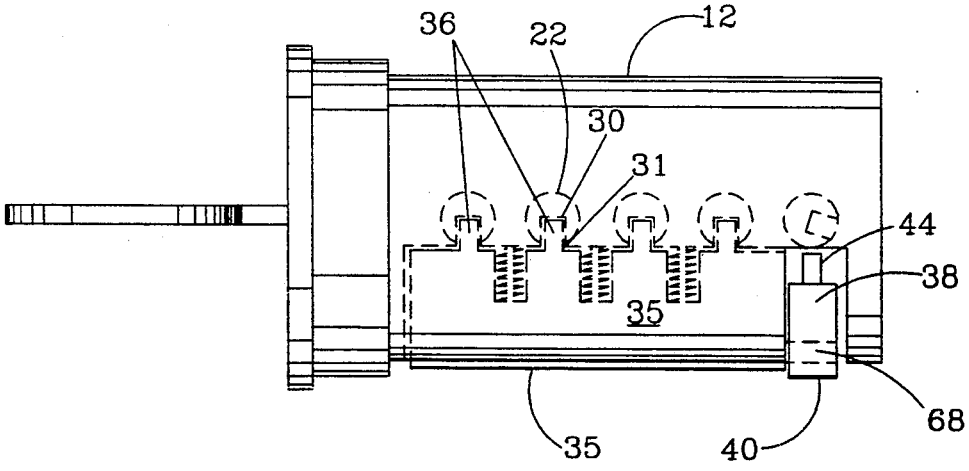
FIG. 5 is a side schematic cut away view of the removable core lock core of FIG. 4 rotated counterclockwise by 90° showing the lock in an unlocked, unremovable mode.
Figure 6:
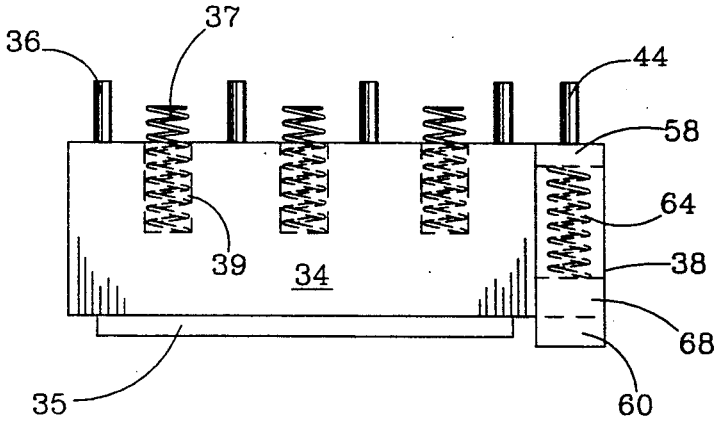
FIG. 6 is a longitudinal side schematic view of the fence assembly of FIGS. 3–5 also showing the various bias springs.
Figure 7:
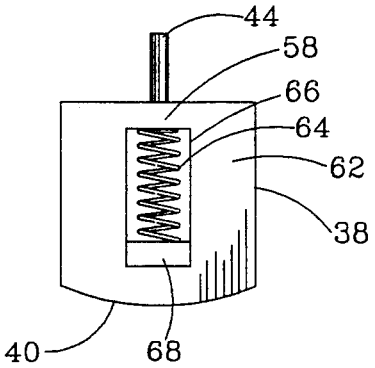
FIG. 7 is a transverse side schematic view of the fence assembly of FIG. 6 from a retainer end showing the bias spring.
Figure 9:
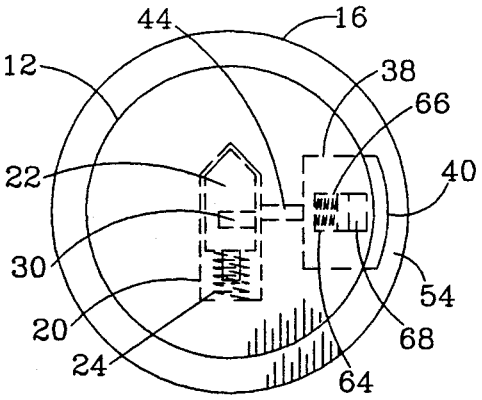
FIG. 9. is a cut away schematic end view of the present removable core lock showing interaction of the retainer fence and tumbler pin in an unlocked, unremovable mode.

The core is held in a locked position with respect to the housing by interengagement between the fence 34 and the locking recess 32 (FIG. 3). To operate the present lock in the unlocked, unremovable mode, a proper operating key A is inserted in the keyway 18 (see FIGS. 2 and 5). The key A is properly bitted with grooves to selectively position the pin tumblers 22 for aligning each inward projection 36 of the fence 34 with a respective transverse pin tumbler opening 30 so that the fence 34 is inwardly slideable for disengagement of the locking surface 35 from the locking recess 32 upon rotation of the core 12 with respect to the housing 16. However, the inward projection 44 of the retainer 38 is not aligned with a respective pin tumbler opening 30 (FIGS. 5 and 9) so that the fence 34 compresses the retainer spring 64 but the outer member 40 of the retainer 38 is maintained in slideable engagement with the retaining surface (e.g. sidewall 54 or endwall 56) to keep the core in the housing.

Figure 10:
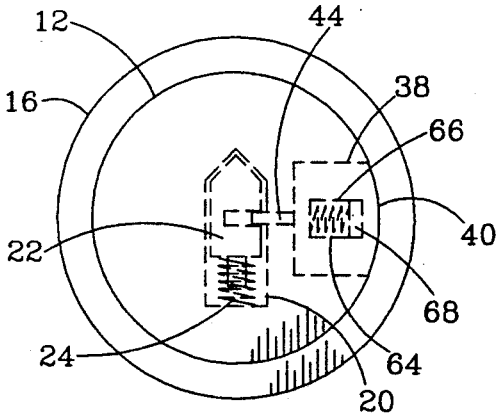
FIG. 10 is a cut away schematic end view of the lock of FIG. 9 shown in a removable mode.
Figure 11:
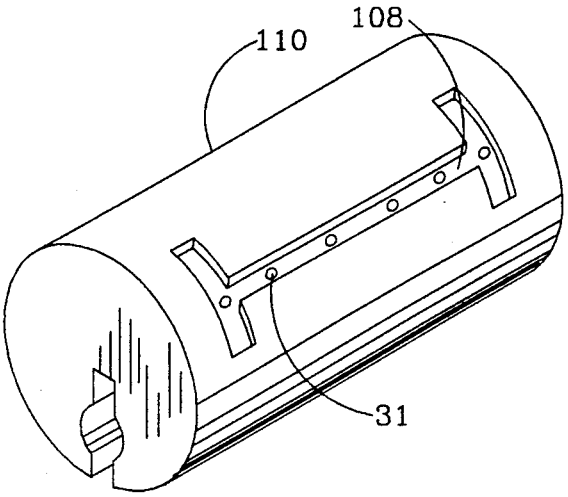
FIG. 11 is a schematic side perspective view of an alternate embodiment of a core of the present removable core lock showing a fence assembly recess having slots for two retainer fences to specify direction of locking/unlocking rotation of the core.
Figure 12:
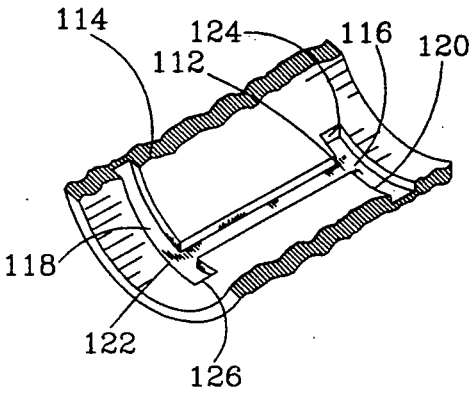
FIG. 12 is a partial perspective view of a lock housing corresponding to the directional rotation embodiment core of FIG. 11 illustrating the locking recess in the inside wall of the housing cavity.
Figure 13:
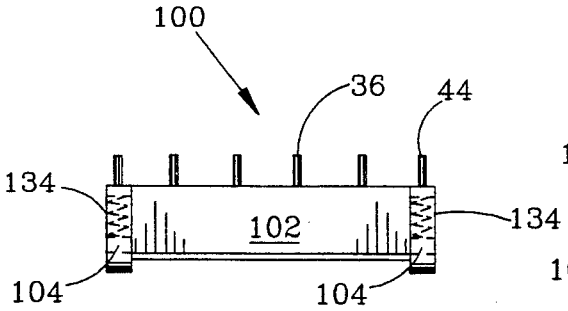
FIG. 13 is a side schematic view of a fence assembly including the retainers of the embodiment of the lock illustrated in FIGS. 11–12.
Figure 14:
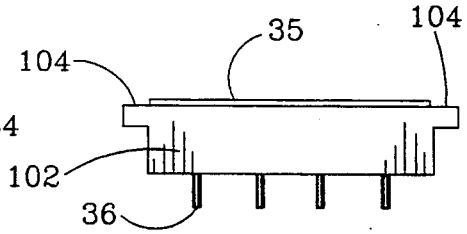
FIG. 14 is a side schematic view of a fence of the embodiment of FIG. 13 without the end retainer fences.
Figure 15:
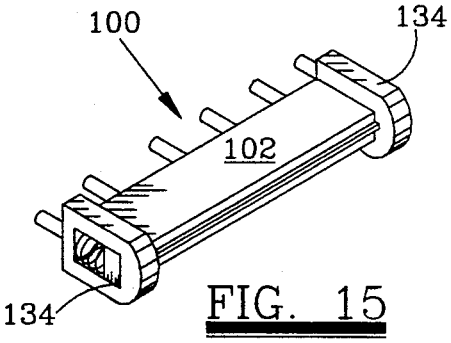
FIG. 15 is a schematic perspective view of the fence assembly of FIG. 13.

To operate the present lock in the removable mode, a proper removal key B (FIG. 2 and 10) is inserted to position the pin tumblers 22 for aligning each inward projection 36, 44 of the fence 34 and of the retainer 38 with a respective pin tumbler opening 30 so that the fence 34 and retainer 38 are inwardly slideable. Rotation of the core 12 with respect to the housing 16 disengages the locking surface 35 from the locking recess 32. Inward movement of the fence 34 inwardly biases the retainer 38 through the retainer spring 64 concurrently disengaging the retainer 38 from the retaining surface to allow removal of the core 12 from the cavity 14.

The present removable core lock is particularly useful in multiple lock networks or systems such as door locks in a building, apartment, hotel, etc. where it is desirable to utilize a single master core removal key to permit rapid replacement of the core when it is necessary to rekey a lock in the system. While multiple lock operating keys are distributed, the security of the cores and hence the whole network is maintained because a key bitting different from the operating key is required to remove the core. It is understood in the art that unauthorized removal of any core in the network can jeopardize the whole network if the master key is deciphered.

Directional operating keys are useful in very high security applications such as in a bank, or an environment containing valuable property or secret information where it is desired to keep surveillance over holders of operating keys.

The foregoing is illustrative and explanatory of the present lock. Many changes in the materials, size, shape and configuration of the various elements and components will become apparent to those skilled in the art. It is intended that all such variations which fall within the scope and spirit of the appended claims be embraced thereby.

What is claimed is:

1. A method of disengaging a removable core cylinder lock, comprising the steps of:

inserting a proper operating key in a keyway of a removable core cylinder lock to selectively position one or more pin tumblers for alignment of a transverse opening formed in each tumbler pin with a fence recess in a core of the lock without aligning one or more of said transverse openings with said fence recess, said lock comprising:

a plurality of pin tumbler bores formed in the core in alignment with the keyway and adjacent the fence recess, a said tumbler pin biased in each of said bores toward the keyway;

a lock housing having a longitudinal cavity slideably receiving the core therein, a locking recess formed in a wall of the cavity, and a transverse retaining surface, an outwardly biased fence disposed in the fence recess having an outer locking surface engaged in the locking recess and at least one inward projection receivable in a said tumbler opening, a normally outwardly biased retainer disposed in the fence recess having an outer member engaged with the retaining surface and at least one inward projection receivable in a tumbler opening, and rotating the core with respect to the housing to inwardly slide each inward projection of the fence into a respective aligned pin tumbler opening to disengage the locking surface of the fence from the locking recess, wherein at least one inward projection of the retainer is not aligned with a respective tumbler opening so that the outer member of the retainer is maintained in slideable engagement with the retaining surface to keep the core in the housing.

2. The method of claim 1, further comprising the steps of removing the operating key, inserting a proper removal key to selectively position the pin tumblers to align each inward projection of the retainer and the fence with a respective pin tumbler opening, rotating the core with respect to the housing to inwardly slide each inward projection of the fence and the retainer into a respective pin tumbler opening for inward disengagement of the locking surface of the fence from the locking recess and of the retainer outer member from the retaining surface, and removing the core from the housing.

3. A removable core cylinder lock, comprising:

a lock core having a keyway, a plurality of pin tumbler bores aligned with the keyway and a fence recess adjacent the bores;

a lock housing having a longitudinal cavity for slideably receiving the core therein, a locking recess formed in a wall of the cavity, and a transverse retaining surface;

a tumbler pin disposed in each of the bores and biased toward the keyway;

a transverse opening formed in each tumbler pin and adapted to be aligned with the fence recess when properly positioned by a key inserted in the keyway;

an outwardly biased fence disposed in the fence recess having an outer locking surface engageable in the locking recess and at least one inward projection receivable in a tumbler opening;

a normally outwardly biased retainer disposed in the fence recess having an outer member engageable with the retaining surface and at least one inward projection receivable in a tumbler opening;

means for inwardly biasing the retainer;

wherein the core is in a locked position with respect to the housing by interengagement between the fence and the locking recess;

wherein the core is operable in an unlocked, unremovable mode by insertion of a proper operating key in the keyway to selectively position the pin tumblers for aligning each inward projection of the fence with a respective pin tumbler opening without alignment of each inward projection of the retainer with a respective pin tumbler opening, so that the fence is inwardly slideable for disengagement of the locking surface from the locking recess upon rotation of the core with respect to the housing and the outer member of the retainer is maintained in slideable engagement with the retaining surface to keep the core in the housing;

wherein the core is operable in a removal mode by insertion of a proper removal key to position the pin tumblers for aligning each inward projection of the fence and of the retainer with a respective pin tumbler opening so that the fence and retainer are inwardly slideable upon rotation of the core with respect to the housing for disengaging the locking surface from the locking recess and the retainer from the retaining surface to allow removal of the core from the cavity.

4. The lock of claim 3, wherein the retainer includes an inner arm carrying the inward projection or projections, an outer arm supported outwardly on the fence, and a member rigidly connecting the inner and outer arms, and wherein the retainer is biased inwardly by a spring disposed between the fence and the inner arm.

5. The lock of claim 3 wherein the fence recess on the core has a longitudinal segment and a transverse segment, and the fence is disposed in the longitudinal segment and the retainer is disposed in the transverse segment.

6. The lock of claim 3, wherein the transverse retaining surface comprises a sidewall of a radial locking recess formed in an interior wall of the cavity.

7. The lock of claim 3, wherein the transverse retaining surface comprises an endwall of the housing.

8. The lock of claim 3, wherein the retainer includes two or more inward projections receivable in separate tumbler openings.

9. The lock of claim 4, wherein the outer arm outward support is a narrow finger formed in the fence and received in a central channel in the retainer adjacent the outer arm.

10. The lock of claim 3, further comprising a second retainer to specify direction of rotation in the unlocking mode.

11. The lock of claim 3, further comprising an operating key in combination therewith.

12. The lock of claim 3, further comprising a removal key in combination therewith.

13. A removable core cylinder lock, comprising:

a lock core having a keyway, a plurality of pin tumbler bores aligned with the keyway, a longitudinal fence recess and a transverse retainer recess adjacent the bores;

a lock housing having a longitudinal cavity for slideably receiving the core therein, a longitudinal locking recess formed in a wall of the cavity opposite the fence recess, and a transverse retaining endwall adjacent the retainer recess;

a tumbler pin disposed in each of the bores and biased toward the keyway;

a transverse opening formed in each tumbler pin and adapted to be aligned with the fence recess when properly positioned by a key inserted in the keyway;

an outwardly biased fence disposed in the fence recess having an outer locking surface engageable in the locking recess and at least one inward projection receivable in a tumbler opening;

a normally outwardly biased retainer disposed in the retainer recess having an inner arm carrying an inward projection receivable in a tumbler opening, an outer arm engageable with the housing endwall, a member rigidly connecting the inner and outer arms and a central channel;

a finger formed on the fence and received in the retainer channel adjacent the outer arm and outwardly supporting the retainer;

a spring between the finger and the inner arm inwardly biasing the retainer;

wherein the core is in a locked position with respect to the housing by interengagement between the retainer and the housing endwall;

wherein the core is operable in an unlocked, unremovable mode by insertion of a proper operating key in the keyway to selectively position the pin tumblers for aligning each inward projection of the fence with a respective pin tumbler opening without alignment of the inward projection of the retainer with a respective pin tumbler opening, so that the fence is inwardly slideable for disengagement of the locking surface from the locking recess upon rotation of the core with respect to the housing and the outer arm of the retainer is maintained in slideable engagement with the housing endwall to keep the core in the housing;

wherein the core is operable in a removal mode by insertion of a proper removal key to position the pin tumblers for aligning each inward projection of the fence and of the retainer with a respective pin tumbler opening so that the fence and retainer are inwardly slideable upon rotation of the core with respect to the housing for disengaging the locking surface from the locking recess and the retainer from the housing endwall to allow removal of the core from the cavity.

14. The lock of claim 13, further comprising an operating key in combination therewith.

15. The lock of claim 13, further comprising a removal key in combination therewith.

* * * * *